United States Patent [19]

Bowser

[11] 4,157,625

[45] Jun. 12, 1979

[54] ENTERTAINMENT LIGHTING DISPLAY

[76] Inventor: Roger C. Bowser, Box 5032, Rte. 3, Apache Junction, Ariz. 85220

[21] Appl. No.: 662,567

[22] Filed: Mar. 1, 1976

[51] Int. Cl.[2] ..... G09F 13/12; G09F 19/16

[52] U.S. Cl. ..... 40/427; 40/219; 40/573; 350/290; 362/140; 362/811

[58] Field of Search ..... 40/219, 106.52, 427, 40/442, 573; 272/8, 8 D, 8 M; 240/10 R; 350/290, 291, 293, 296; 362/135, 140, 806, 811

[56] References Cited

U.S. PATENT DOCUMENTS

| | | | |
|---|---|---|---|
| 2,132,473 | 10/1938 | Holm | 272/8 M |
| 2,222,301 | 11/1940 | Rappaport | 40/563 X |
| 2,286,247 | 6/1942 | Yearta | 40/219 |
| 2,483,901 | 10/1949 | Harris | 272/8 M |
| 3,611,603 | 10/1971 | Gesner | 240/10 R |
| 3,811,041 | 5/1974 | Matsushita | 240/10 R |

FOREIGN PATENT DOCUMENTS

| | | | |
|---|---|---|---|
| 1229912 | 4/1971 | United Kingdom | 40/219 |

*Primary Examiner*—John F. Pitrelli
*Attorney, Agent, or Firm*—Gregory J. Nelson

[57] ABSTRACT

A lighting display of relatively thin proportions producing a visual image of substantial depth by creating multiple reflections of light sources and objects within a narrow space. The space is defined by a vertical, rear mirror plate and a front one-way mirror which appears substantially transparent from a viewer area. Images from the light sources in the spaces are repeatedly reflected back-and-forth between the front and rear mirrors.

6 Claims, 9 Drawing Figures

ENTERTAINMENT LIGHTING DISPLAY

BACKGROUND OF THE INVENTION

The present invention relates to lighting displays, and relates more particularly to electrical lighting arrangements of quite narrow proportions producing illusions of extensive depth and space.

One approach in producing multiple reflections and illusions of substantial depth has been to place a plurality of identical light sources or identical objects in alignment spaced forwardly of and at differing distances from a rear mirror. To a viewer area in front of the entire assemblage, there is presented one reflection of each object or light, thereby producing a total number of images of twice the number of actual light sources. Such arrangement requires relatively substantial space in front of the mirror, and of course the illusion of depth is limited to only twice the distance between the mirror and the light source farthest away therefrom.

Another known illusion of substantial depth is created by a "barbershop" effect where two mirrors are located on opposite sides of a viewer space. Multiple images of objects within the space appear in each mirror. Obviously, of course, the image can only be seen by a viewer situated within the space between the mirrors.

SUMMARY OF THE INVENTION

It is an important object of the present invention to provide a lighting display of relatively thin, narrow proportions capable of producing a visual image of extensive depth many times its width.

Another important object is to provide a display of the type described in the preceding paragraph which creates a multiple reflection image visible to an area outside the display itself, thereby presenting a display and visual image capable of being utilized for entertainment purposes.

More particularly, the invention contemplates a lighting display utilizing a vertical, rear mirror plate and a parallel, one-way plate mirror located in front of the rear mirror to define a space therebetween. Illuminations means including incandescent and/or fluorescent electrical entertainment lights are positioned in the narrow space between the mirrors. The one-way mirror is arranged and characterized by appearing transparent to a viewer area in front of the display so that the lights and space between the mirrors are visible to the viewer area whenever the light intensity striking the one-way mirror from the space between the mirrors is greater than that striking the front of the one-way mirror from the viewer area. While images from each light source and reflections from the rear mirror are transmitted through the one-way mirror to the viewer area, a portion of each such image and reflection is also reflected by the one-way mirror back to the rear mirror. Accordingly, there is presented to the viewer area multiple reflections of the lights and other objects in the space between the mirrors and a corresponding illusion of extensive depth. Various lighting arrangements and combinations including variations in spacing of lights from the rear mirror are incorporated, along with controls for selectively energizing the various lights, to produce a variety of unusual, entertaining displays. For large, outdoor entertainment displays for vast viewing areas, the apparatus is constructed in modular form for ease of assembly and transport.

These and other objects and advantages of the present invention are specifically set forth in or will become apparent from the following detailed description of a preferred embodiment of the invention when read in conjunction with the accompanying drawings.

DESCRIPTION OF THE PREFERRED EMBODIMENT

Figure 1:
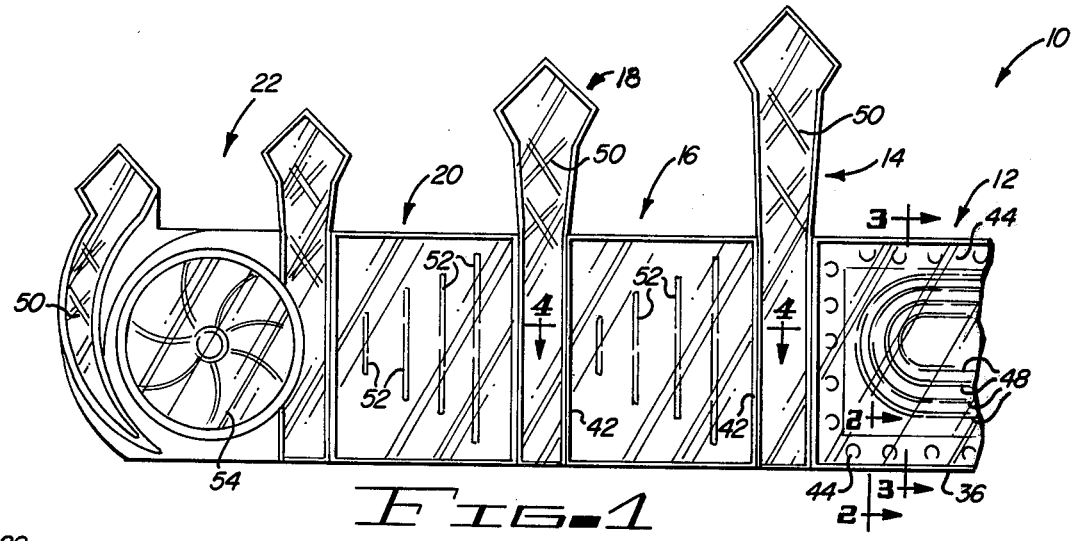
FIG. 1 is a front elevational, partial view from the viewer area of lighting display constructed in accordance with the principles of the present invention.

Referring now more particularly to the drawings, an entertainment lighting display or apparatus, generally denoted by the numeral 10, includes a plurality of sections including a center section 12, and a pair of different side sections 14, 16, 18, 20 and 22 on opposite sides of the center section, one of each pair being illustrated in FIG. 1. Each section is bounded by a vertical rear plate element or mirror 24 such as a transparent glass plate 26 having a silver coated, reflective, mirrored surface 28. At the front of each section is a front one-way mirror element 30 extending in vertically parallel, spaced arrangement to the rear mirror 24.

Figure 2:
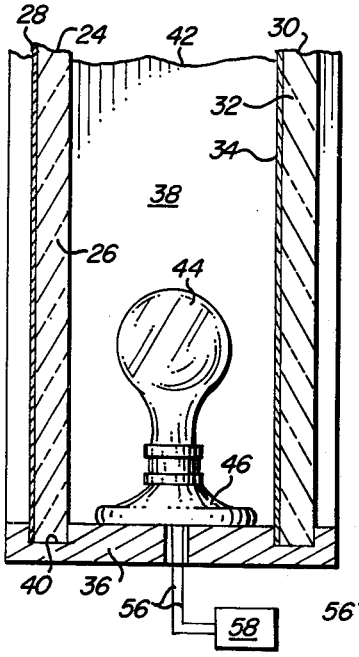
FIGS. 2 and 3 are fragmentary cross-sectional elevational views taken along lines 2—2 and 3—3 respectively of FIG. 1, with electrical controls and circuitry schematically depicted.
Figure 3:
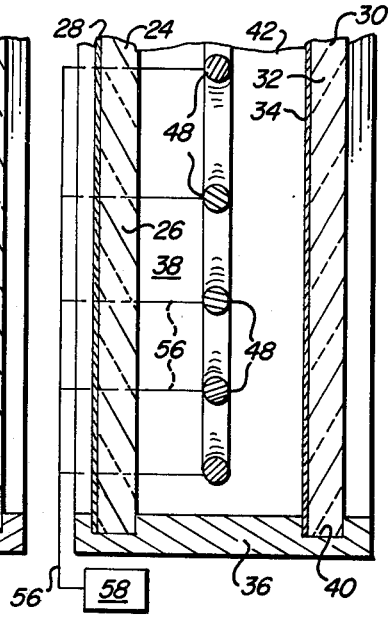

One-way mirror 30 may be constructed of a variety of commercially available material such as Monolithic Clear "DUOVUE" (a registered trademark) Transparent Mirror, manufactured by and available from ASG Industries Inc., P.O. Box 38229, San Francisco, Calif. The mirror 30 may be a glass plate 32 appropriately impregnated, coated or incorporating a second plate of different material all as schematically depicted by portion 34 in FIGS. 2–4. Mirror 30 is characterized by appearing substantially transparent when viewed from one side while acting as a substantially totally reflective mirror when viewed from the opposite side. In at least some such one-way reflective material, and possibly all such material presently known, mirror 30 appears reflective from the side receiving the greater light intensity, while from the side being struck by a lesser intensity of light the mirror 30 is transparent.

Connecting means including a peripheral rim 36 of opaque material such as wood or metal extend around the periphery of mirrors 24 and 30 to cooperate therewith in enclosing and defining a relatively narrow, thin space 38 between the mirrors. Rim 36 is effective to inhibit entry of external light into space 38 through its periphery. The rim 36 is operable to intersecure the mirrors in spaced relationship by convenient connection such as receiving the edges of the mirrors in appropriate grooves 40. The vertical segments 42 of the rim of each section of the display act as opaque barriers traversing and dividing space 38 into a plurality of separate compartments, one corresponding to each of the display sections 12–22. Other barriers may be incorporated to divide the corresponding compartment of any such section into a plurality of sub-compartments of any desired configuration. By providing opaque barriers and rims the lighting displays of each compartment can remain separated without overlap or interference with one another.

Figure 4:
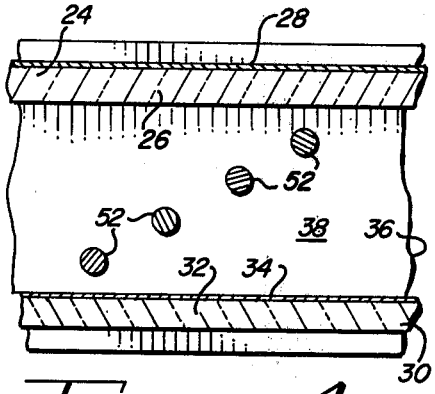
FIG. 4 is a fragmentary transverse cross-sectional plan view taken along lines 4—4 of FIG. 1.

Disposed within space 38 are illumination means including various light sources such as incandescent or fluorescent electrical lights or equivalent light sources. Center section 12 includes a plurality of incandescent lights 44 arranged around its periphery with corresponding socket fixtures 46 affixed to rim 36 and vertical segments 42. Generally centrally located in section 12 are a plurality of concentric, substantially ellipsoidal loops of fluorescent "neon" tubular lights 48. Within sections 14 and 18 are criss-crossing fluorescent lights 50, while sections 16 and 40 have vertical fluorescent lights 52 of differing lengths and located at differing transverse distances from rear mirror 24 as shown in FIG. 4. Section 22 includes criss-crossing lights 50 as in sections 14, 18, as well as curved, spoke-arranged tubular fluorescent lights 54 within its circular portion. The various electrical lights are preferably of different colors, i.e. emanating different colors of light.

Figure 5:
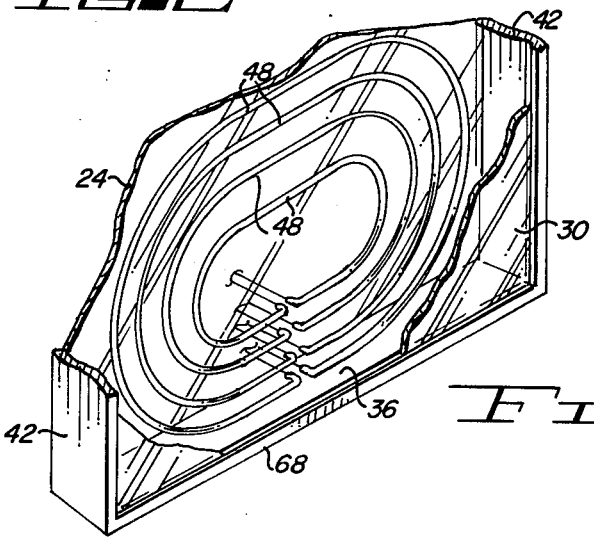
FIG. 5 is a partial perspective view of the center section of the display of FIG. 1 with portions broken away to reveal details of construction.
Figure 9:
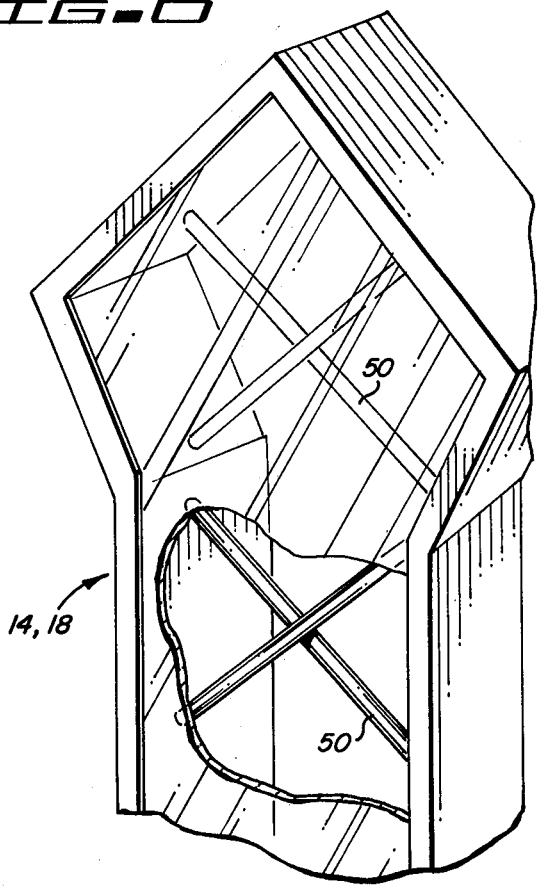
FIG. 9 is an enlarged fragmentary view of lights 50 as incorporated in sections 14, 18 and 22.

The lights are secured in stationary relationship in space 38, being mounted either to the rim or barriers as through fixtures 46 or being secured to rear mirror 24 as are the ellipsoidal lights 48 in FIG. 5. Electrical connections including schematically depicted conductor connections 56 also extend through either the rear mirror 24, peripheral rim 36, or dividing barrier or segment 42, to electrically connect the different lights with suitable electrical controls and power source schematically depicted at 58. Through conventional electrical circuitry including parallel and series interconnection of the lights with the power source as well as switching controls, the lights in each compartment of space 38 are selectively energized and de-energized to produce desired synchronized or serial activation of individual or banks of lights. For instance, by use of conventional switching and timing circuitry various illusions of moving images can be generated, such as the illusion of a rotating wheel by serial energization of lights 54, the appearance of upwardly and downwardly moving spiral "barber" stripes by serial energization of criss-crossing lights 50, as clearly illustrated in FIG. 9, a moving "marquee" effect by sequential activation and de-activation of lights 44, and different flashing or stroboscopic effects through synchronous energization of any or all of the banks of light 44, 48–54. Any and all such visual effects are realized through conventional circuitry well known to those skilled in the art. Particularly for impressive and unusually breathtaking combined light and sound entertainment, acoustically activated electrical controls can form a portion of control and power source 58 so that the lights are energized in harmony with accompanying music.

Figure 6:
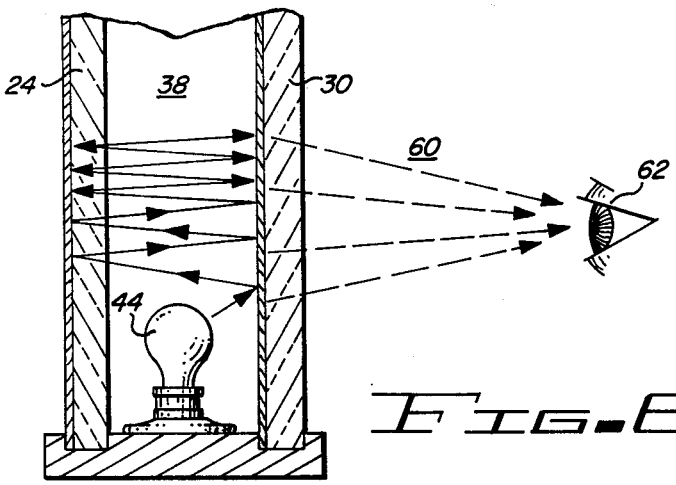
FIG. 6 is a schematic representation of the operating principles of the invention illustrating generation of multiple reflection images.
Figure 7:
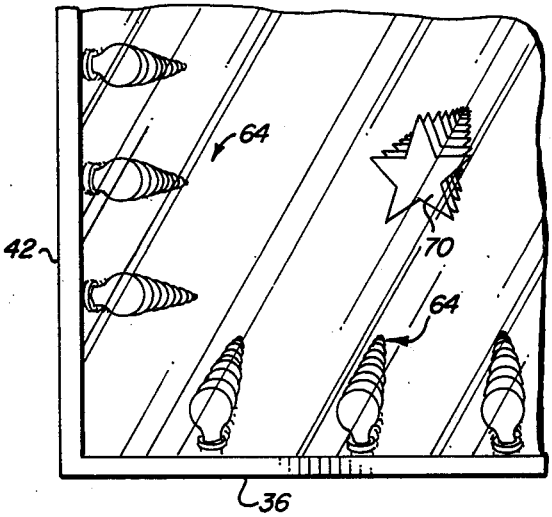
FIG. 7 is front elevational view of a portion of the display of FIG. 1 illustrating the multiple reflection image presented to the viewer area.

In use, the one-way mirror 30 is arranged such that upon energization of the various lights 44, 48–54, the front mirror 30 is substantially transparent to a viewer area 60 in front of the display as depicted in FIG. 6. Thus, as shown by dashed lines, images from a light 44 as well as other objects in space 38 are transmitted to reach the eye 62 of a viewer. Also, reflections from rear mirror 24 are transmitted to the viewer. From the rear side of mirror 30 containing space 38, however, a portion of the image, instead of being transmitted through the mirror 30 is reflected back to rear mirror 24. Continual back-and-forth reflections between the two mirrors within space 38, as depicted by solid, arrowed lines in FIG. 6, thus produces multiple images of the lights and other objects in space 38. Accordingly, when seen from the viewer area a multiple reflection image 64 of space 38 and the lights and any transparent or opaque object 70 therewithin illuminated by the lights, and a corresponding illusion of extensive depth is created as illustrated in FIG. 7.

The display 10 thereby presents a visual appearance of multiple reflections of a single object or light extending a substantial distance away from the viewer. Yet the display is of relatively thin proportions in comparison to the illusion of extensive depth it creates. For instance, in one arrangement a total of forty-two separate, distinct and readily cognizable images of a single light source could be readily identified and counted from the viewer area. A corresponding illusion of depth forty-two times the actual width of space 38 resulted. Its slight relative thickness permits use of the apparatus as a practical on-stage entertainment display for public gatherings, or as a wall-mounted display suitable for home or private use.

Whenever the lights within space 38 are de-energized and the external conditions in the viewer area are appropriate, one-way mirror 30 will act substantially as a mirror surface reflecting the viewer area. Thus, further unusual visual effects can be created by alternately changing the relative intensities of light striking the opposite surfaces of mirror 30, alternately singly reflecting images from the viewer area and transmitting the multiplied, depth image of space 38. To enhance such effects the edges of rim 36 and vertical segments 42 on the viewer side of space 38 can be provided with mirror facings 68 as shown in FIG. 5.

Figure 8:
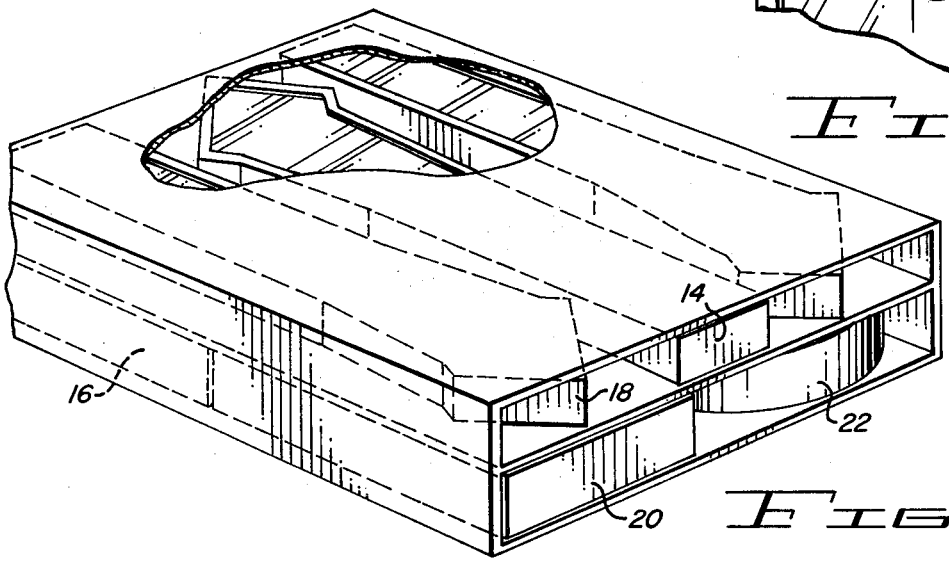
FIG. 8 is a perspective view showing a plurality of the modular sections disassembled and stacked for compact storage and transportation.

In conjunction with the display 10 described above, appropriate bracing and scaffolding (not shown) are incorporated, preferably behind rear mirror 24, to hold upright such displays which are used for indoor or outdoor entertainment. Furthermore, large entertainment displays of the type referred to can be constructed in easily assembled, modular form by constructing each section 12–22 separately. Thus, disassembly and storage for transport can be quickly effected by stacking of the modular sections as illustrated in FIG. 8. This also allows the sections to be assembled in different order to produce different, overall lighting displays from the same sections or components. For wall use, appropriate mounting of the display to the wall holds it secure.

While the mirrors 24 and 30 illustrated are flat, vertical, parallel plates, it will be apparent that various non-parallel, non-flat, mirror arrangements, or distortion-type mirrors may be utilized. Similarly, the mirrors may be constructed of various materials other than the plate glass described. For instance, utilization of color discriminatory reflective surfaces, either for rear mirror 24 or for one-way mirror 30 may be utilized. By constructing both the front and rear mirrors of one-way mirror material, the multiple image effect is presented to both the area behind the rear mirror as well as the area in front of the front mirror.

These and various other modifications and alterations will be apparent to those skilled in the art. Accordingly, the foregoing detailed description of a preferred embodiment should be considered exemplary in nature and not as limiting to the scope and spirit of the invention as set forth in the accompanying claims.

Having described the invention with sufficient clarity that those skilled in the art may make and use it, what is desired to be secured by Letters Patent and claimed is:

1. Lighting display for a viewer area, comprising:

a rear mirror facing the viewer area;

a one-way mirror disposed intermediate said rear mirror and the viewer area to define a space between said rear mirror and said one-way mirror, said one-way mirror arranged to appear substantially transparent to the viewer area while presenting a reflective surface to said space;

a substantially opaque rim enclosing the periphery of said space and intersecuring said rear mirror and said one-way mirror in spaced relationship;

a plurality of opaque barriers traversing said space to divide the latter into a plurality of compartments; and separate electrical lights disposed in each of said compartments whereby said one-way mirror and said rear mirror repeatedly reflect light from said lights to produce multiple reflection images of said lights to the viewer area, said lights in at least one of said compartments comprising at least three vertical, parallel, thin fluorescent lights of differing vertical lengths and equally transversely spaced from one another, said vertical lights being spaced at differing distances from said rear mirror in relation to their differing vertical lengths.

2. A display as set forth in claim 1, wherein said lights in another of said compartments comprise electrical fluorescent lights operably mounted to said rear mirror and arranged in a plurality of concentric ellipsoidal configurations generally centrally located in said another compartment.

3. A display as set forth in claim 2, wherein said rear mirror and said one-way mirror are substantially flat and extend in substantially vertical, parallel, planes parallel to a vertical plane containing said ellipsoidal lights.

4. A relatively thin entertainment lighting display for producing a visual image of relatively extensive depth to a viewer area in front of said display, said display comprising:

a generally vertical flat, rear plate having a mirrored surface facing the viewer area;

a generally vertical, flat, frontal, one-way mirror element disposed in closely adjacent, generally parallel arrangement to said rear plate to define a relatively thin space between said rear plate and said frontal one-way mirror, said one-way mirror arranged to appear substantially transparent to the viewer area whenever the intensity of light in said space is greater than that in the viewer area, said rear plate and said one-way mirror operable to repeatedly reflect light in said space back-and-forth therebetween;

means for interconnecting said rear plate and said one-way mirror in said spaced relationship, said means being substantially opaque and enclosing the periphery of said space to prevent entry of light into said space through said periphery, said means further including opaque barrier members extending across said space to divide the latter into a central compartment and at least a pair of side compartments on each side of said central compartment;

illumination means disposed in said space whereby light therefrom is repeatedly reflected by said rear mirror and said one-way mirror to produce multiple images of said illumination means to the viewer area, whereby said display partakes of an appearance of extensive depth extending away from the viewer area a distance substantially greater than the thickness of said relatively thin space, said illumination means including a plurality of ellipsoidally configured electrical lights operably mounted to said rear plate and concentrically arranged to one another in said central compartment, and a plurality of vertical, parallel electrical lights of differing vertical length disposed in each of said side compartments, said vertical lights in each of the side compartments being equally transversely spaced thereacross and being spaced at differing distances from said rear plate in relation to their differing vertical lengths; and means for selectively energizing said electrical lights whereby the intensity of light in said space is selectively greater than the intensity of light striking said one-way mirror from the viewer area.

5. A display as set forth in claim 6, wherein said display is comprised of a plurality of separable, modular sections, one section corresponding to each of said compartments.

6. A display as set forth in claim 4, wherein said barriers further define columnar compartments between each of said side and central compartments of substantially greater vertical height and less horizontal, transverse width than said side and central compartments, said illumination means further including in each of said columnar components a vertical series of diagonally criss-crossing electrical lights.

* * * * *